US008081901B2

(12) United States Patent
Atwood et al.

(10) Patent No.: US 8,081,901 B2
(45) Date of Patent: Dec. 20, 2011

(54) XEROGRAPHIC MARKING MODULE USEFUL IN A XEROGRAPHIC COLOR MARKING SYSTEM

(75) Inventors: Mark A. Atwood, Rush, NY (US); James J Spence, Honeoye Falls, NY (US)

(73) Assignee: Xerox Corporation, Norwalk, CT (US)

( * ) Notice: Subject to any disclaimer, the term of this patent is extended or adjusted under 35 U.S.C. 154(b) by 679 days.

(21) Appl. No.: 12/189,313

(22) Filed: Aug. 11, 2008

(65) Prior Publication Data

US 2010/0034556 A1 Feb. 11, 2010

(51) Int. Cl.
*G03G 21/18* (2006.01)

(52) U.S. Cl. ..... 399/111; 254/122; 254/10 R; 254/123; 254/124; 254/126; 187/211; 187/269; 248/637; 248/669; 248/421; 248/676; 248/588; 248/396; 248/277.1; 248/129

(58) Field of Classification Search ..... 399/107–114, 399/126, 411; 254/122–126, 10 R; 187/211, 187/269; 248/637, 669, 676, 421, 588, 396, 248/277.1
See application file for complete search history.

(56) References Cited

U.S. PATENT DOCUMENTS 6,418,286 B1 7/2002 Hou
2001/0008588 A1 * 7/2001 Numazu et al. ..... 399/107

OTHER PUBLICATIONS

See Co-Pending Related U.S. Appl. No. 12/189,379, p. 2.

* cited by examiner

*Primary Examiner* — David Gray
*Assistant Examiner* — Ruth Labombard
(74) *Attorney, Agent, or Firm* — Ronald E. Prass, Jr.; Prass LLP

(57) ABSTRACT

This invention provides a xerographic marking module that has a built-in lifting mechanism that is useful in installing a new module in a xerographic marking system. The lifting mechanism forms the bottom portion of the marking module and comprises an upper cradle to hold the remaining module portion, a lower plate that constitutes the bottom of the module when in a collapsed position, and a movable linkage that connects the cradle to the lower plate. When in installation mode, the linkage creates a vertical force which will upwardly push the cradle (holding the module) away from the lower plate into an installation elevation. After slides in the module and in the color marking system are mated, the lifting mechanism is collapsed and the module pushed into the color marking system or apparatus.

18 Claims, 7 Drawing Sheets

XEROGRAPHIC MARKING MODULE USEFUL IN A XEROGRAPHIC COLOR MARKING SYSTEM

CROSS REFERENCES TO RELATED APPLICATIONS

Illustrated and disclosed in co-pending application Ser. No. 12/189,379 entitled "Cart with Xero Module Lift Assist" and owned by the same assignee as the present application is subject matter relating to a cart used in removing or installing modules from a system. The patent application based upon application Ser. No. 12/189,379 and the present application, ID 20080421Q, application Ser. No. 12/189,313 are filed concurrently in the US Patent and Trademark Office. The disclosure of ID 20080421 application Ser. No. 12/189,379 is totally incorporated by reference.

The present invention relates to color imaging machines and, more specifically, to imaging modules used in these machines.

BACKGROUND

There is known a color system where an array or series of different color imaging stations or modules are aligned above an endless belt. Each station contains an upper positioned raster output scanner (ROS), and below the ROS is an imaging station or module comprising a photoreceptor drum, development station, and cleaning station. The ROS emits an electronic beam (laser) which impinges on the rotating photoconductive drum, thereby causing that location on the drum to undergo a change in electrical charge. As the drum continues to rotate past the development station, toner particles of a color which is unique to that imaging station will attach to the drum at the location charged by the ROS. This colored image is then transferred to an intermediate transfer belt that is passing by, and in contact with, the photoreceptor drum. As the intermediate belt passes by the different imaging stations (each containing a different color) it picks up subsequent color layers to create a complete color image which is then subsequently transferred to media.

Each colored beam must be in substantial registration with the other beams deposited on the belt for a final color copy. This registration and color quality is monitored by a sensor(s) to ensure proper color density, etc. If any color needs to be changed, the color imaging station is moved or replaced. In one embodiment there are also two sensors (Mark On Belt, or MOB sensors) that are fixed in position to a point on the machine frame, such that the colored images pass within view of these sensors. These sensors serve to detect, among other conditions, the quality of the colors. Generally, each ROS unit and color imaging station is separable and is each a distinct module. This type of color system having an array of ROS units and color imaging modules is generally described in U.S. Pat. No. 6,418,286 and is incorporated by reference into this disclosure.

As noted above, the color image deposited on the drum is subsequently deposited onto the intermediate belt. As the drum continues to rotate, it passes through the development station with a latent image which causes toner to stick to the drum where the electrical discharging (by the ROS) has taken place. The drum further rotates until the image is in contact with this intermediate transfer belt where the image is transferred from the drum to the belt. Each of the six or plurality of imaging stations deposits its own color and subsequently movement of the belt is moved past each of the imaging stations and allows each of the color separations to be deposited in turn. Thus, when the colors are diminished in quality as indicated by sensors, the color module needs to be changed. Also in some cases a new color is desired; thus a new replacement module is needed.

It is important that the customer have the ability to perform their own color station change over. Color changeover will be achieved by removing the toner dispenser system and the Xerographic marking module as separate units. The targeted weight of the prior art Xerographic module weighs in excess of 32 pounds. To compound this challenge, the customer is required to attach the module onto slides while the module is held steady, resulting in a safety hazard or realistic difficult task.

SUMMARY

The present invention provides a xerographic marking module that has, as a part of its make up, a module lift mechanism. When the lift mechanism is in its collapsed mode, the upper cradle and lift linkage will be nested in the lower plate with the upper cradle resting on top of the lift linkage and lower plate.

The upper cradle is slightly larger than the module so that the module will fit snugly therein. The upper cradle is slightly smaller than the lower plate so that when not in use the cradle will fit snugly into the lower plate when not in use. The xerographic marking module comprises the lifting mechanism in addition to the developer unit and xerographic drum. The lifting mechanism comprises an upper cradle, a lower plate and a folding movable linkage between the cradle and lower plate. The xerographic marking module fits on top of and is attached to the lifting mechanism.

When a replacement xerographic marking module is to be installed into the color imaging machine, the module with lifting mechanism is merely placed upon a supporting surface and the lifting mechanism activated manually or mechanically by any suitable means. The lifting mechanism is similar to a scissors jack and may be utilized as is a scissors jack. Any other means such as hydraulic lifting or pump lifting may be used provided it conveniently and securely lifts the module to the installation location height.

The lift assist linkage of this invention has an upper support component which functions as the cradle plate to house the entire module and the lower frame plate which will be placed on a support. When engaged or actuated, the linkage assembly will create a vertical force which will push the cradle assembly upwardly away from the base plate. When the linkage reaches its maximum travel, the cradle will position the xerographic module in its installation elevation. When the lifting mechanism is inactive, it will be in its collapsed state which places the xerographic module in its storage state. Once collapsed, the mechanism will be hidden between the cradle base and the cart mount plate with the cradle base resting on top of the cart mount plate.

The forces required to lift the xerographic module at a state of equilibrium or less will be delivered manually or via any suitable mechanical device. This invention illustrates in one embodiment the use of a torsion spring acting about an axis to deliver a sloping force into the linkage while the operator provides an upward force onto the handle however, obviously, other suitable lift means can be used. As the cradle travels upward, the force profile will act downward. This invention can be utilized with any mechanical force generator to act as a reactionary force to the module's weight.

Once the lift mechanism reaches its travel, a slight force up or down allows the height of the module to be adjusted so that the module slides can be easily engaged with the color system slides. Once the proper height is achieved, a stop can be set so that the mechanism can be returned to the same position for any subsequent removal of the module.

DETAILED DESCRIPTION OF THE DRAWING AND PREFERRED EMBODIMENTS

Figure 1:
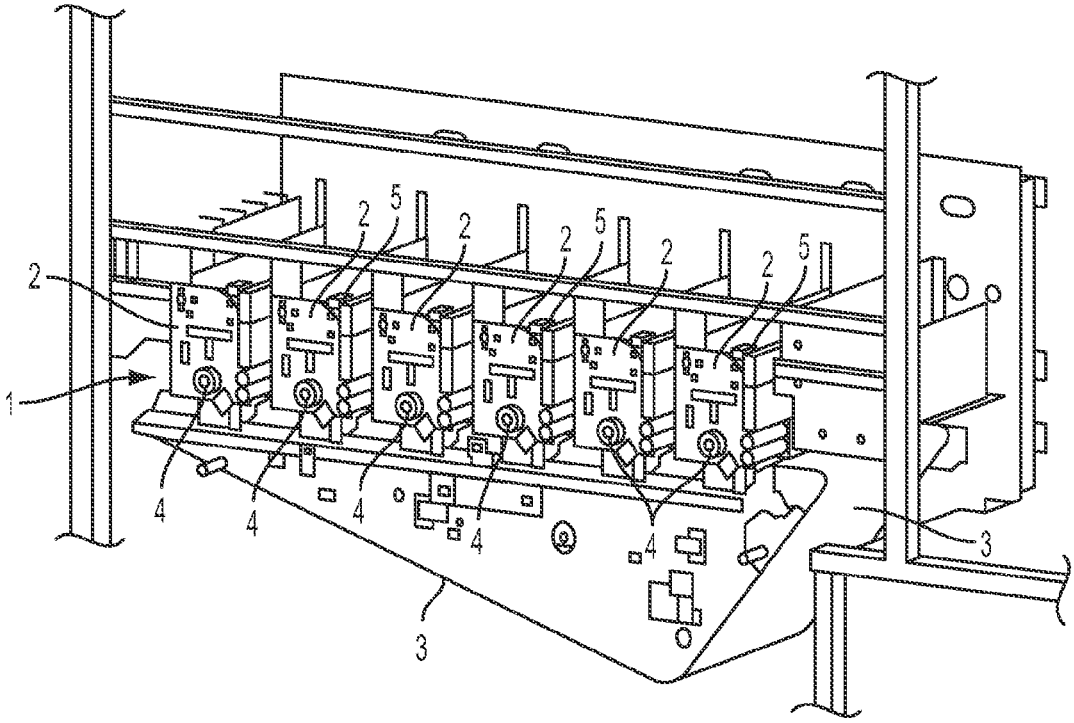
FIG. 1 PRIOR ART
FIG. 1 is a front perspective view of a typical prior art color marking apparatus or machine without ROS units.

In FIG. 1, a xerographic color apparatus (minus the raster output scanner-ROS for clarity) is shown as used in the prior art. The color xerographic marking apparatus or system 1 comprises an array of different color producing imaging modules 2 aligned along the path of an intermediate endless photoreceptor belt 3. Each imaging module 2 is positioned below Raster Output Scanners (ROS) not shown in FIG. 1 but shown as element 6 in FIG. 2. The ROS emits an electronic beam which impinges on the rotating photoconductive drum (see FIG. 2) thereby causing that location on the drum to undergo a change in electrical charge. This colored image is then transferred to an intermediate photoreceptor transfer belt 3 that is passing by and in contact with the photoreceptor drum or drum connector 4. This image is then transferred from belt 3 to a receiving media or paper for a final copy. The modules 2 comprise along with other components a photoconductive drum 4 and developer containers 5. When the customer wishes to change the color in the module 2, he removes the module 2 from the xerographic color apparatus or system 1 and replaces it with a new different color containing module 2. Since each module 2 is relatively heavy, i.e. 30-35 pounds, removal and replacement can be a difficult task. To alleviate this difficulty, the present invention provides a convenient assisting means.

Figure 2:
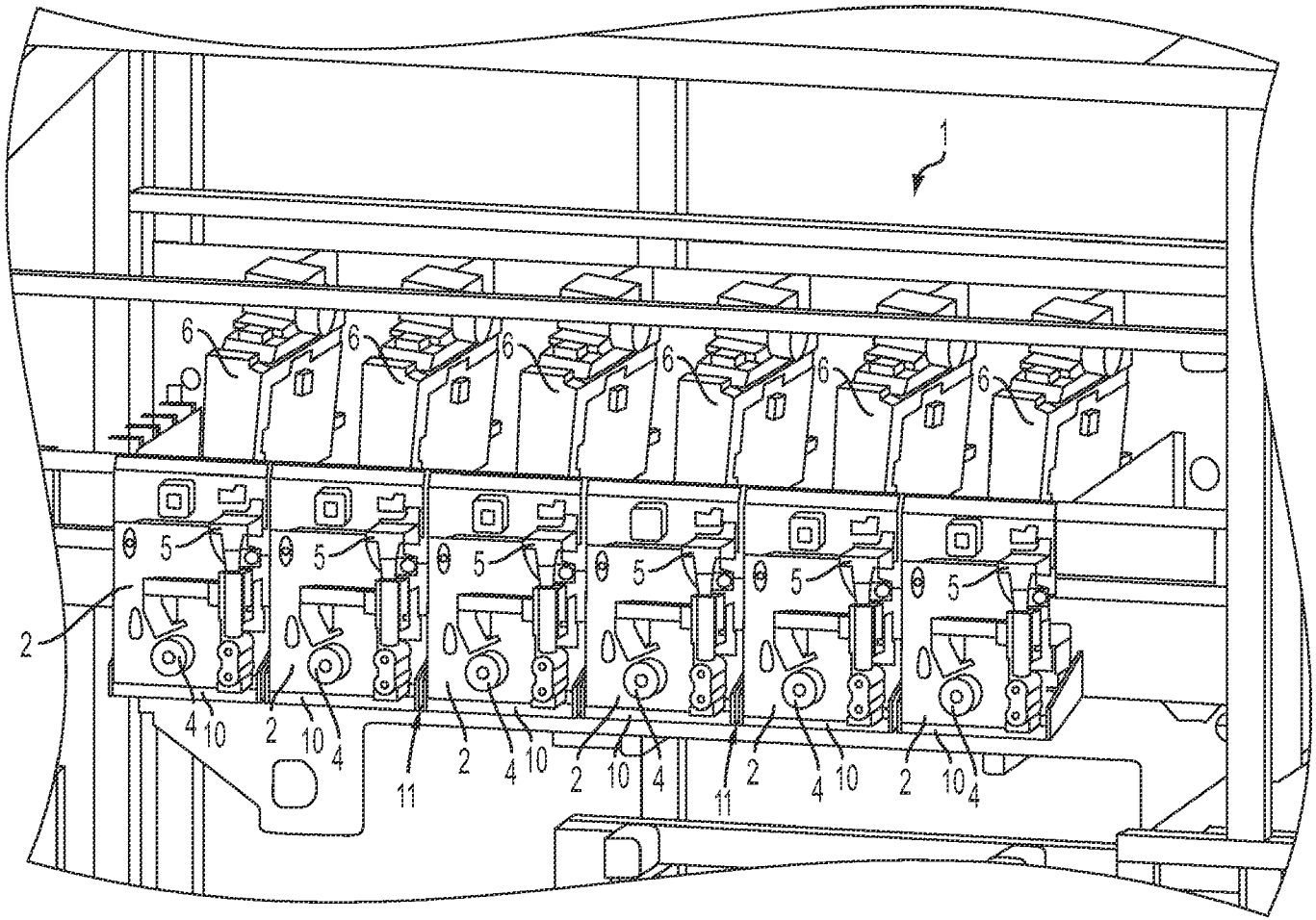
FIG. 2 is the type of color marking system of FIG. 1 without the intermediate belt (for clarity) and using the imaging stations or modules of the present invention.

In FIG. 2, a xerographic color marking system 1 is illustrated (minus belt 3 for clarity). Each module 2 has as its lower portion a lifting mechanism 8, 9, 10 in its collapsed form. When this lift mechanism 8, 9, 10 is in the collapsed mode, the upper cradle 8 and lift linkage 9 will be nested in the lower plate 10 with the upper cradle 8 resting on top of the lift linkage 9 (see FIG. 5). When one of the modules 2 is to be removed from system 1, the module 2 is merely pulled out and removed. The module 2 with its bottom lifting mechanism 8, 9, 10 is placed on any suitable support surface and the lifting mechanism 8, 9, 10 activated so that it supports the module 2 as it is lowered from a module location 11. When the new module is to be installed, the new module 2 with its collapsed bottom lifting mechanism 8, 9, 10 is placed on a suitable support. The lifting mechanism 8, 9, 10 is then activated manually or mechanically and the module is lifted to the module location 11 in the system 1.

Figure 3:
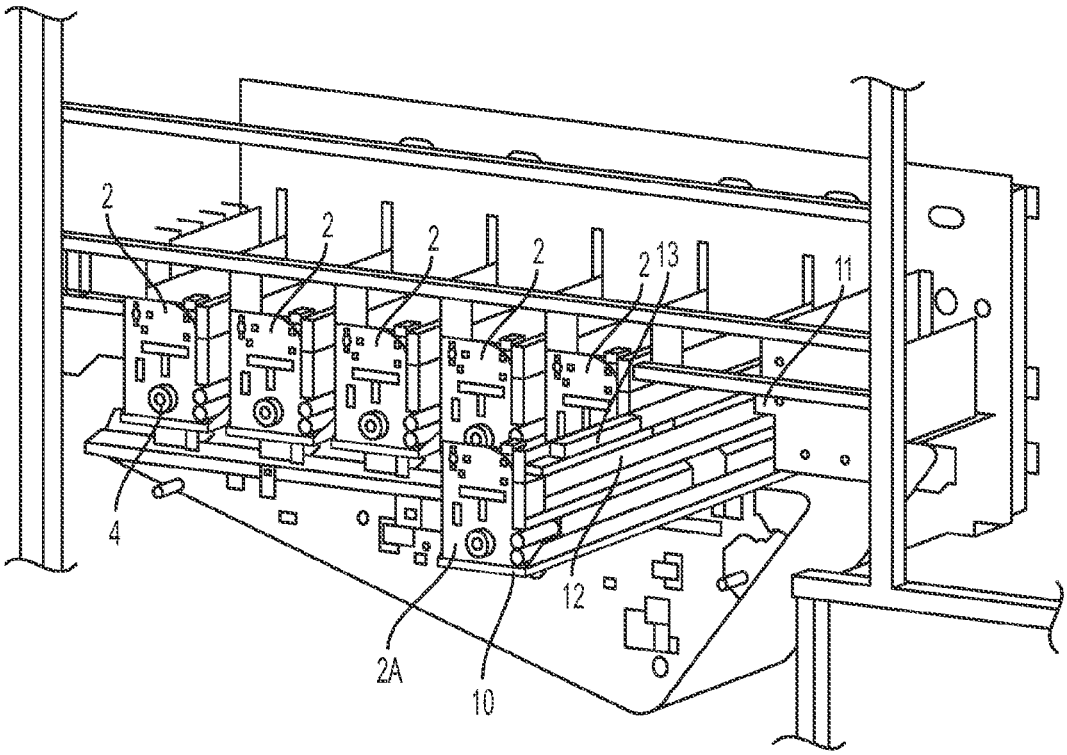
FIG. 3 illustrates the color system of FIG. 2 with one of the imaging stations or modules pulled out in preparation for removal.

In FIG. 3, a removable module 2A is illustrated as it is being removed from the color system 1 where upper module slides 12 are released from contact with system mating slides 13. Once the slides 12 and 13 are disconnected, a support (not shown) is placed adjacent the module 2A and the lifting mechanism 8, 9, 10 is activated so that lower plate 10 rests on the support. The lifting mechanism 8, 9, 10 is then lowered so that it is in the collapsed mode after removal.

To install the replacement module 2 in the space 11 after removal of module 2A (of FIG. 3), the module 2 with its attached collapsed lifting mechanism 8, 9, 10 is placed onto a support surface, the lifting surface is activated to its lift position and raised until the replacement module is adjacent to space 11. The system slides 13 are pulled from the space 11 and slides 13 are mated with module slides 12. The lifting mechanism is then collapsed and replacement module 2 is pushed via slides 12 and 13 into the module space 11.

Figure 4:
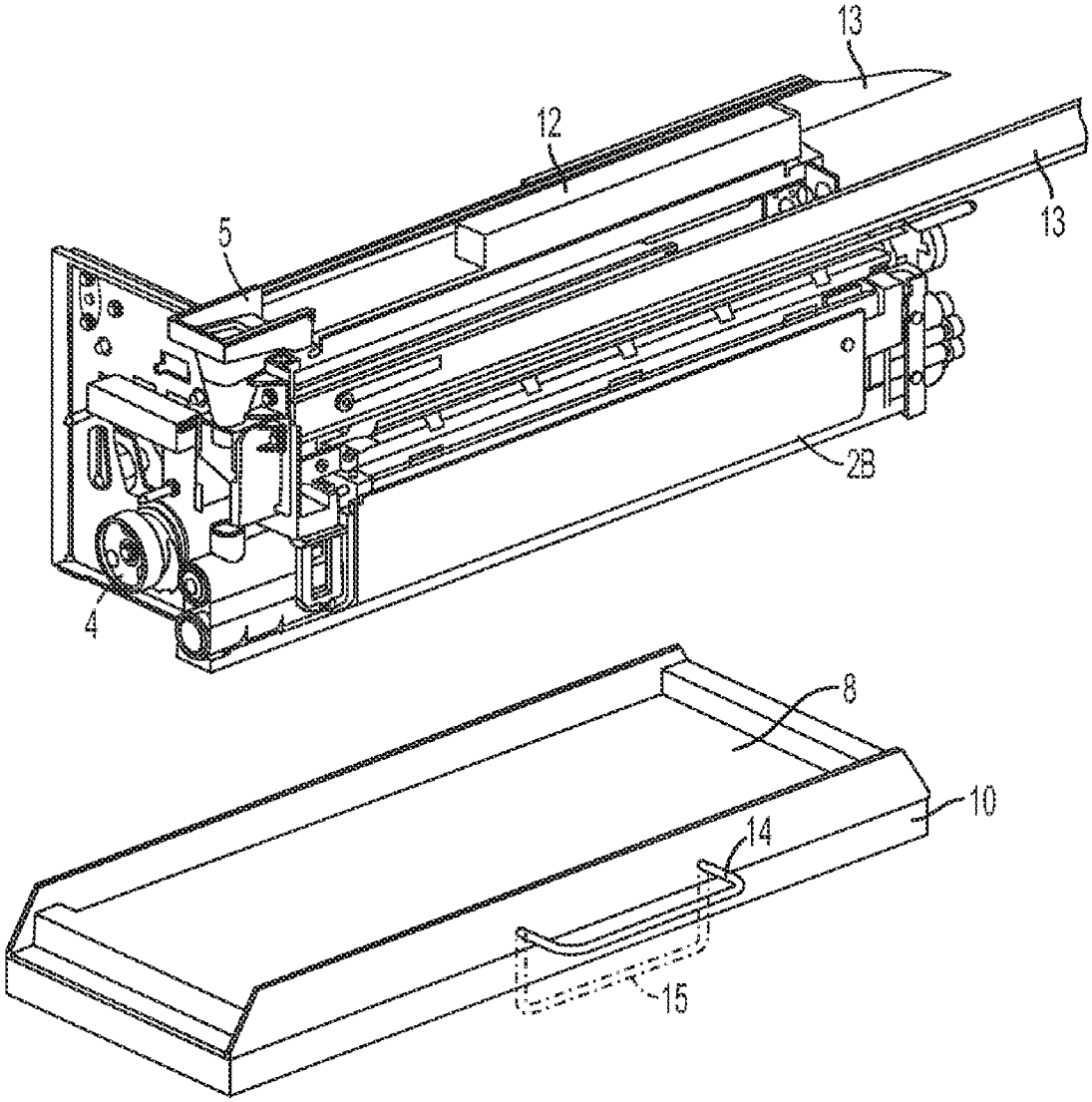
FIG. 4 is a front perspective view of an embodiment of the imaging module of this invention showing the lifting mechanism (in inactive status) separated from the imaging module prior to the attachment to this imaging module.

In FIG. 4, an embodiment of the module 2 of this invention is shown in an exploded view. The main portion 2B of module 2 is shown detached from lifting mechanism 8, 9, 10.

The collapsed lifting mechanism 8, 9, 10 of FIG. 4 which will be part of module 2 when connected to main module 2B comprises a lower plate 10 which houses upper cradle 8; between the cradle 8 and the lower plate 10 is the concealed or hidden lift linkage 9. A folding extended handle 14 is shown where the folded down or depressed handle 14 is shown by dotted lines 15. This folding handle 14 reduces the space required by the installed module 2. The handle 14 can be used when removing module 2 from space 11 or when installing module 2A by aligning slides 12 and 13 during installation.

Figure 5A:
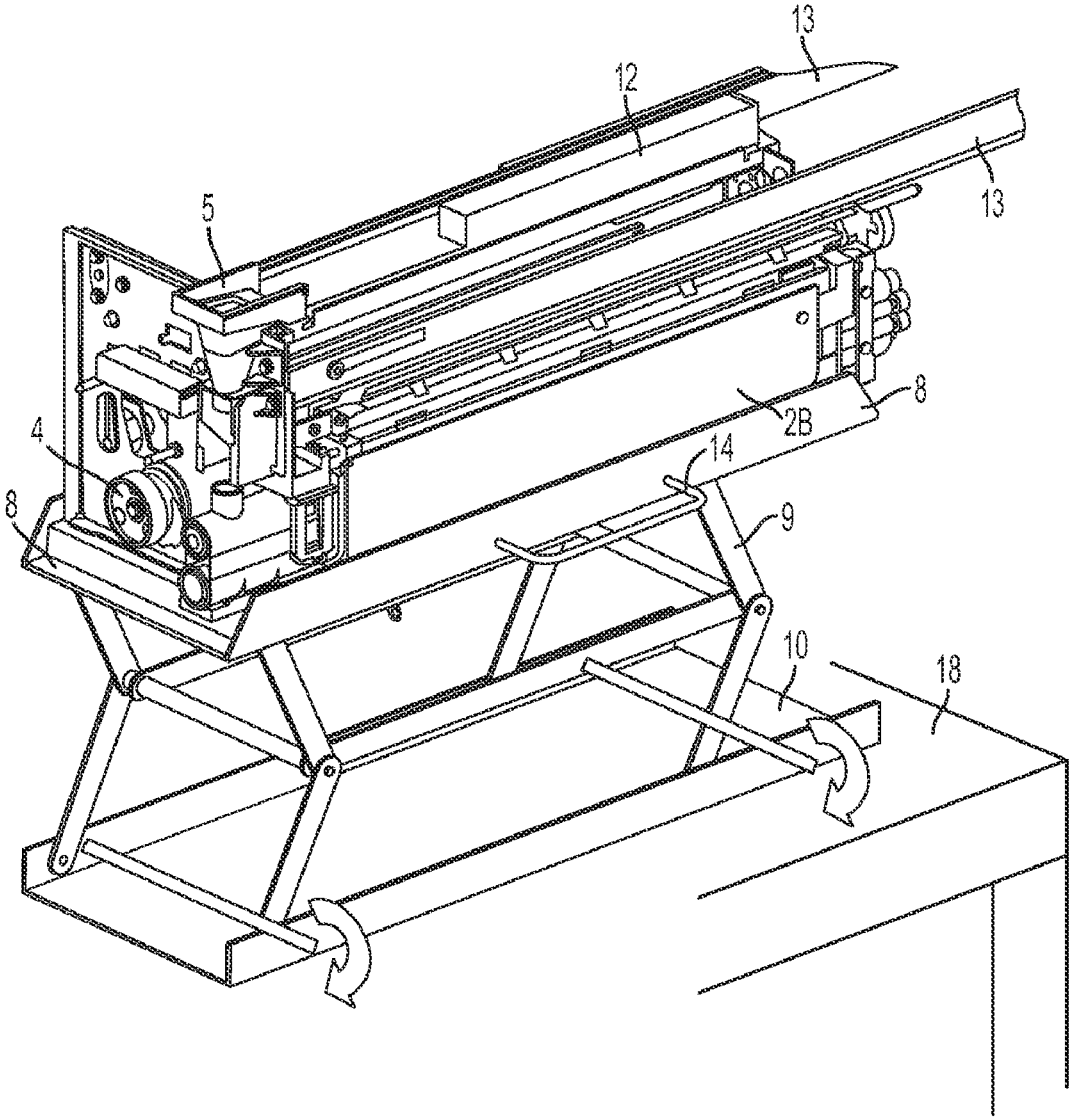
FIG. 5 is a front perspective view of the imaging module of this invention during its activation prior to installation in the color imaging system.
FIG. 5B is a front perspective view of the imaging module in its collapsed position being attached to the sides of the marking system.
Figure 5B:
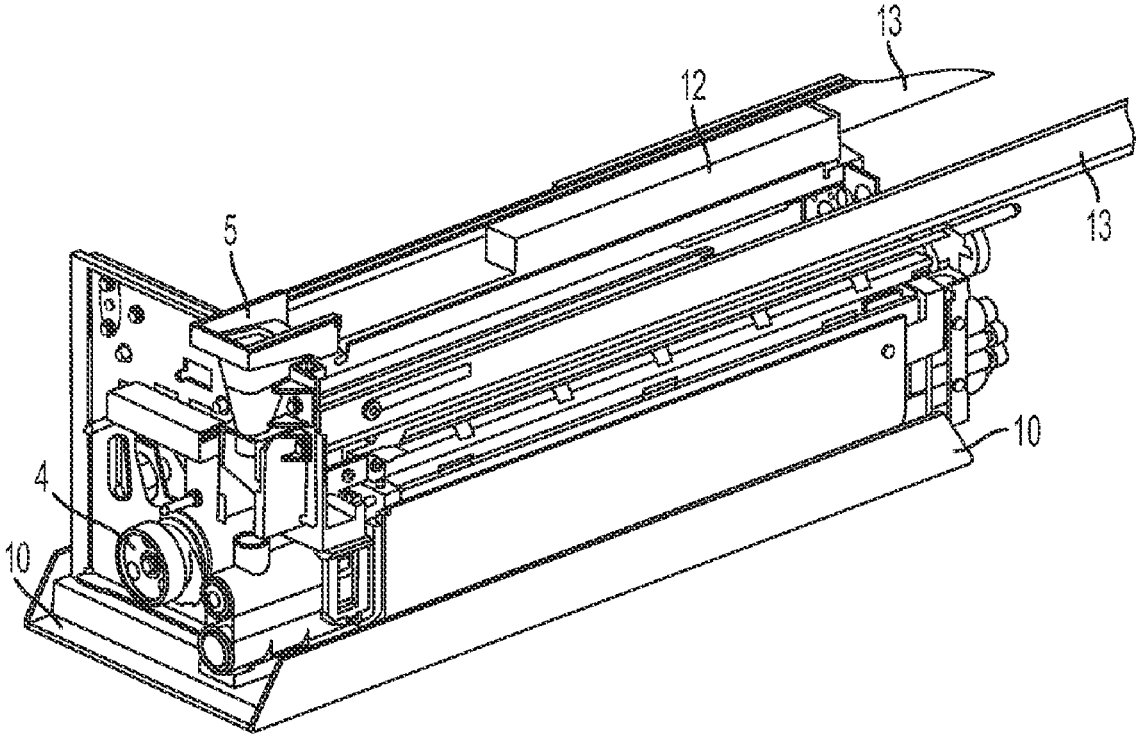

In FIG. 5A, the module 2 is shown in its activated form with main module 2B resting in cradle 8. Base plate 10 rests on a flat support 15 during the lifting step. Once the module is adjacent to space 11 and the slides 12 and 13 are connected, the lifting mechanism 8, 9, 10 is collapsed and module 2 pushed into the space 11 of the marking apparatus. The fold down handles 14 on both sides of cradle 8 allow the customer to raise or lower the modules 2 to engage slides 12 and 13. Lift linkage 9 may be raised or lowered by hand or mechanically by any suitable lifting means. Once module 2 is ready to be installed, lifting mechanism 8, 9, 10 is collapsed (as shown in FIG. 5B) and the lifting linkage will fold and nest in base plate 10. The cradle 8 will also fold into larger base plate 10.

In FIG. 5B the module 2 is shown in the collapsed position where the linkage 9 will be hidden (when folded) between the upper cradle 8 and the lower base plate 10. Once the slides 12 and 13 have been connected, the lifting mechanism 8, 9, 10 is collapsed as shown in FIG. 5B so that the module 2 can now be slid or pushed into the color marking system 1 via the slides 12 and 13. Once installed, the module 2 as shown in this figure is functional and ready for use.

Figure 6:
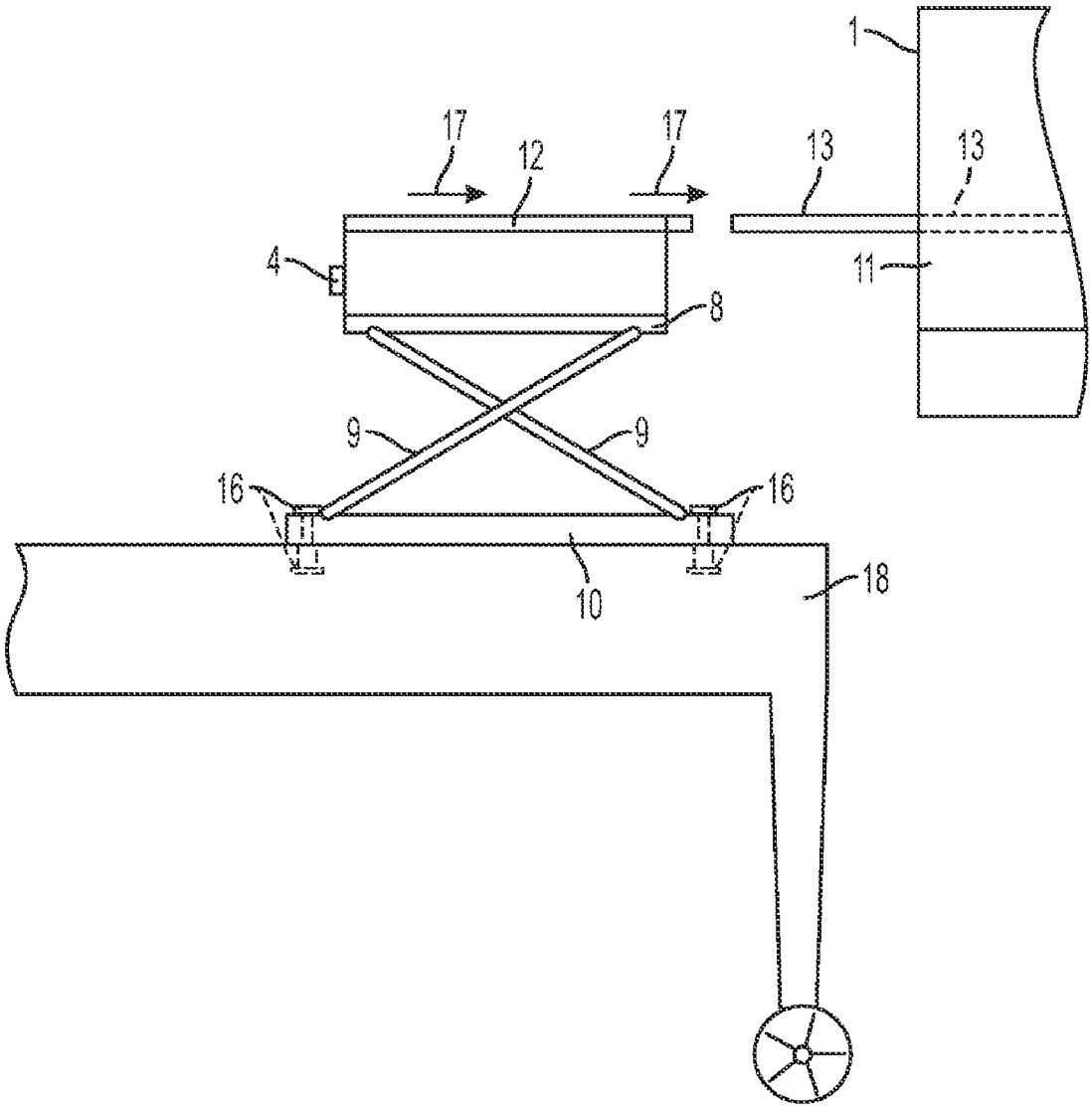
FIG. 6 illustrates a module about to be installed into a color imaging apparatus or system.

In FIG. 6, a replacement module 2A is shown as it is about to be installed in color marking system 1 and into module space 11. The module 2A is lifted to the installation location and once module slides 12 are connected securely to system slides 13, the lifting mechanism 8, 9, 10 is depressed and the module 2A pushed into installed position into space 11. During the lifting step, the module 2 is resting on a support 18 and may be temporarily tightened on support 18 by clamps 16. The arrows 17 show the direction module 2A is pushed into space 11 via slides 12 and 13.

To install the module 2:

(1), the xerographic module 2 is raised to the appropriate height;

(2) the module 2 is than aligned with both mating slides 12 and 13 and pushed in until slides 12 and 13 are engaged;

The cradle 8 is lowered into base pate 10-leaving module 2 hanging on the slides 12 and 13;

The module 2 is then pushed completely in the marking system 1 and secured.

The embodiments of this invention provide a xerographic marking module useful in a xerographic color marking system, this module comprising a photoconductive drum, a color developer container or housing, and a module lifting mechanism as part of the module and located at a bottom portion of the module. The lifting mechanism comprises an upper cradle, a lower plate, and a movable linkage between the cradle and the lower plate. The cradle is configured to hold and support the xerographic marking module. The linkage, when activated, is enabled to create a vertical force which will upwardly push the cradle away from said lower plate into an installation elevation relative to the color marking system. The lifting mechanism is configured to be in a collapsed position when not in installation use. When in a collapsed position, the linkage will be hidden between the upper cradle and the lower plate with the cradle resting on top of the lower plate. The upper cradle is slightly less than coextensive with the module and is enabled to firmly hold and nest the module during an installation or removal procedure. The lift mechanism is enabled when it reaches its upward travel limit to be adjusted up or down by an upward or downward force. The upper cradle in one embodiment has fold-down handles on both side portions, the handles are enabled to hold the module steady during an installation or removal procedure. The lifting mechanism and the upper cradle are configured to fit into and concealed in the lower plate when the lifting mechanism is in an inactive storage mode. The lifting mechanism is configured so that once a proper installation height is achieved, a stop is provided so that the mechanism can be returned to a same position for subsequent removal of the module.

In summary, in an embodiment this xerographic marking module that is useful in a xerographic color marking system comprises: a photoconductive drum, a color developer container or housing, and a module lifting mechanism as part of the module and located at a bottom portion of said module. The lifting mechanism comprises an upper cradle, a lower plate and a movable linkage between the cradle and the lower plate. This lifting mechanism is configured to be collapsed and compacted at the bottom portion just prior to the module being inserted into the xerographic color marking system.

It will be appreciated that variations of the above-disclosed and other features and functions, or alternatives thereof, may be desirably combined into many other different systems or application. Also, that various presently unforeseen or unanticipated alternatives, modifications, variations or improvements therein may be subsequently made by those skilled in the art which are also intended to be encompassed by the following claims.

What is claimed is:

1. A xerographic marking module useful in a color marking system, said xerographic marking module comprising:

a photoconductive drum a color developer container or housing, and a lifting mechanism as part of said xerographic marking module and located at a bottom portion of said xerographic marking module, said lifting mechanism comprising an upper cradle, a lower plate, and a movable linkage between said upper cradle and said lower plate, wherein said upper cradle has fold-down handles on both side portions, said fold-down handles enabled to hold said xerographic marking module steady during an installation or removal procedure.

2. The xerographic marking module, of claim 1, wherein said upper cradle is configured to hold and support said xerographic marking module.

3. The xerographic marking module, of claim 1, wherein said movable linkage when activated is enabled to create a vertical force which will upwardly push said upper cradle away from said lower plate into an installation elevation relative to said color marking system.

4. The xerographic marking module of claim 1, wherein said lifting mechanism is configured to be in a collapsed position when not in installation use, while in a collapsed position, said movable linkage hidden between said upper cradle and said lower plate with said upper cradle resting on top of said lower plate.

5. The xerographic marking module of claim 1, wherein said upper cradle is slightly less than coextensive with said xerographic marking module and enabled to firmly hold and nest said xerographic marking module during an installation or removal procedure.

6. The xerographic marking module of claim 1, wherein said lifting mechanism is enabled when it reaches its upward travel limit to be adjusted up or down by an upward or downward force.

7. The xerographic marking module of claim 1, wherein said lifting mechanism and said upper cradle are configured to fit into and are concealed in said lower plate when said lifting mechanism is in an inactive storage mode.

8. The xerographic marking module of claim 1, wherein said upper cradle is configured to permit said xerographic marking module to be pushed therefrom into said color marking system after the proper adjustment and height are achieved.

9. The xerographic marking module of claim 1, wherein said lifting mechanism is configured so that once a proper installation height is achieved, a stop is provided so that said lifting mechanism can be returned to a same position for subsequent removal of said xerographic marking module.

10. A xerographic marking module useful in a color marking system, said xerographic marking module comprising:

a photoconductive drum, a color developer container or housing, and a lifting mechanism as part of said xerographic marking module and located at a bottom portion of said xerographic marking module, said lifting mechanism comprising an upper cradle, a lower plate and a movable linkage between said upper cradle and said lower plate, said lifting mechanism configured to be collapsed and compacted at said bottom portion just prior to said xerographic marking module being inserted into said color marking system, wherein said upper cradle has fold-down handles on both side portions, said fold-down handles enabled to hold said xerographic marking module steady during an installation or removal procedure.

11. The xerographic marking module of claim 10, wherein said upper cradle is configured to hold and support said xerographic marking module.

12. The xerographic marking module of claim 10, wherein said movable linkage when activated is enabled to create a vertical force which will upwardly push said upper cradle away from said lower plate into an installation elevation relative to said color marking system.

13. The xerographic marking module of claim 10, wherein said lifting mechanism is configured to be in a collapsed position when not in installation use, while in a collapsed position, said movable linkage will be hidden between said upper cradle and said lower plate with said upper cradle resting on top of said lower plate.

14. The xerographic marking module of claim 10, wherein said upper cradle is slightly less than coextensive with said xerographic marking module and is enabled to firmly hold and nest said xerographic marking module during an installation or removal procedure.

15. The xerographic marking module of claim 10, wherein said lifting mechanism is enabled when it reaches its upward travel limit to be adjusted up or down by an upward or downward force.

16. The xerographic marking module of claim 10, wherein said lifting mechanism and said upper cradle are configured to fit into and are concealed in said lower plate when said lifting mechanism is in an inactive storage mode.

17. The xerographic marking module of claim 10, wherein said upper cradle is configured to permit said xerographic marking module to be pushed therefrom into said color marking system after the proper adjustment and height is achieved.

18. The xerographic marking module of claim 10, wherein said lifting mechanism is configured so that once a proper installation height is achieved, a stop is provided so that said lifting mechanism can be returned to a same position for subsequent removal of said xerographic marking module.

* * * * *